US006499465B1

(12) United States Patent
Mahr et al.

(10) Patent No.: US 6,499,465 B1
(45) Date of Patent: Dec. 31, 2002

(54) FUEL INJECTION SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 9 days.

(21) Appl. No.: 09/807,879

(22) PCT Filed: Aug. 2, 2000

(86) PCT No.: PCT/DE00/02550

§ 371 (c)(1),
(2), (4) Date: May 30, 2001

(87) PCT Pub. No.: WO01/14710

PCT Pub. Date: Mar. 1, 2001

(30) Foreign Application Priority Data

Aug. 20, 1999 (DE) ..... 199 39 424

(51) Int. Cl.[7] ..... F02M 45/00; F02M 63/00
(52) U.S. Cl. ..... 123/447; 123/467
(58) Field of Search ..... 123/446, 447, 123/456, 467, 506

(56) References Cited

U.S. PATENT DOCUMENTS

| | | | | |
|---|---|---|---|---|
| 4,421,088 A | * | 12/1983 | Seilly | 123/447 |
| 5,072,706 A | | 12/1991 | Eblen | 123/297 |
| 5,357,929 A | * | 10/1994 | McCandless | 123/446 |

FOREIGN PATENT DOCUMENTS

| | | |
|---|---|---|
| DE | 29 07 279 A1 | 8/1980 |
| DE | 41 18 237 A1 | 12/1991 |
| EP | 0 711 914 A1 | 5/1996 |
| WO | WO 98/09068 | 3/1998 |

* cited by examiner

*Primary Examiner*—Tony M. Argenbright
(74) *Attorney, Agent, or Firm*—Ronald E. Greigg

(57) ABSTRACT

A fuel injection system having at least two different, high system pressures for an internal combustion engine, includes a first central pressure reservoir for the lower system pressure and includes a second central pressure reservoir, supplied from a high-pressure pump, for the higher system pressure, both pressure reservoirs being connectable by line to the injector of each cylinder, and to increase the efficiency, a two-stage high-pressure pump, by whose lower stage the first pressure reservoir and by whose higher stage the second pressure reservoir are supplied.

6 Claims, 6 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 00/02550 filed on Aug. 2, 2000.

BACKGROUND OF THE INVENTION

1. Field of the Invention

The invention is based on a fuel injection system for an internal combustion engine and particularly to such a fuel injection system having at least two high system pressures.

2. Description of the Prior Art

One fuel injection system of the type with which this invention is concerned has been disclosed by European Patent Disclosure EP 0 711 914 A1.

For better comprehension of the ensuing description, several terms will first be explained in further detail: In a pressure-controlled fuel injection system, a valve body (such as a nozzle needle) is opened counter to the action of a closing force by the fuel pressure prevailing in the nozzle chamber of an injector, and the injection opening is thus uncovered for an injection of the fuel. The pressure at which fuel emerges from the nozzle chamber into the cylinder is called the injection pressure, while system pressure is understood to mean the pressure at which fuel is available or is stored in the injection system. The term stroke-controlled fuel injection system is understood in the context of the invention to mean that the opening and closure of the injection opening of an injector are done with the aid of a displaceable valve member, on the basis of the hydraulic cooperation of the fuel pressures in a nozzle chamber and in a control chamber. In a combined fuel metering, a switch is made between various injection pressures, and only one common valve is used for metering the fuel; the switchover can be done either centrally, that is, prior to the fuel distribution to the individual cylinders, or locally, that is, individually for each cylinder.

In the pressure-controlled injection system known from EP 0 711 914 A1, fuel is compressed to a first, high system pressure of about 1200 bar with the aid of a high-pressure pump and is stored in a first pressure reservoir. The fuel at high pressure is also pumped into a second pressure reservoir, in which by regulation of its fuel delivery by means of a 2/2-way valve, a second, high system pressure of about 400 bar is maintained. Via a valve control unit, either the lower or the higher system pressure is directed into the nozzle chamber of an injector. There, by means of the pressure, a spring-loaded valve body is lifted from its valve seat, so that fuel can emerge from the nozzle opening.

In this known injection system, it is disadvantageous that all the fuel must first be compressed to the higher system pressure level so that then some of the fuel can be relieved again to the lower system pressure level.

SUMMARY OF THE INVENTION

The fuel injection system of the invention, which can be pressure-controlled or stroke-controlled, in order to increase its efficiency, it is proposed that only the fuel for one pressure reservoir be compressed to the higher system pressure level, while the fuel for the other pressure reservoir is compressed only to the lower system pressure level.

What according to the invention is the lesser fuel quantity at the higher system pressure leads not only to higher efficiency but also to a reduced load on the pump components, and since the higher system pressure need not be sealed off from normal pressure but only from the other high, yet lower, system pressure, this leads to improved sealing and thus less leakage.

BRIEF DESCRIPTION OF THE DRAWINGS

Further advantages and advantageous features of the subject of the invention can be learned from the description contained herein below, taken in conjunction with the drawings, in which.

DESCRIPTION OF THE PREFERRED EMBODIMENTS

Figure 1A:
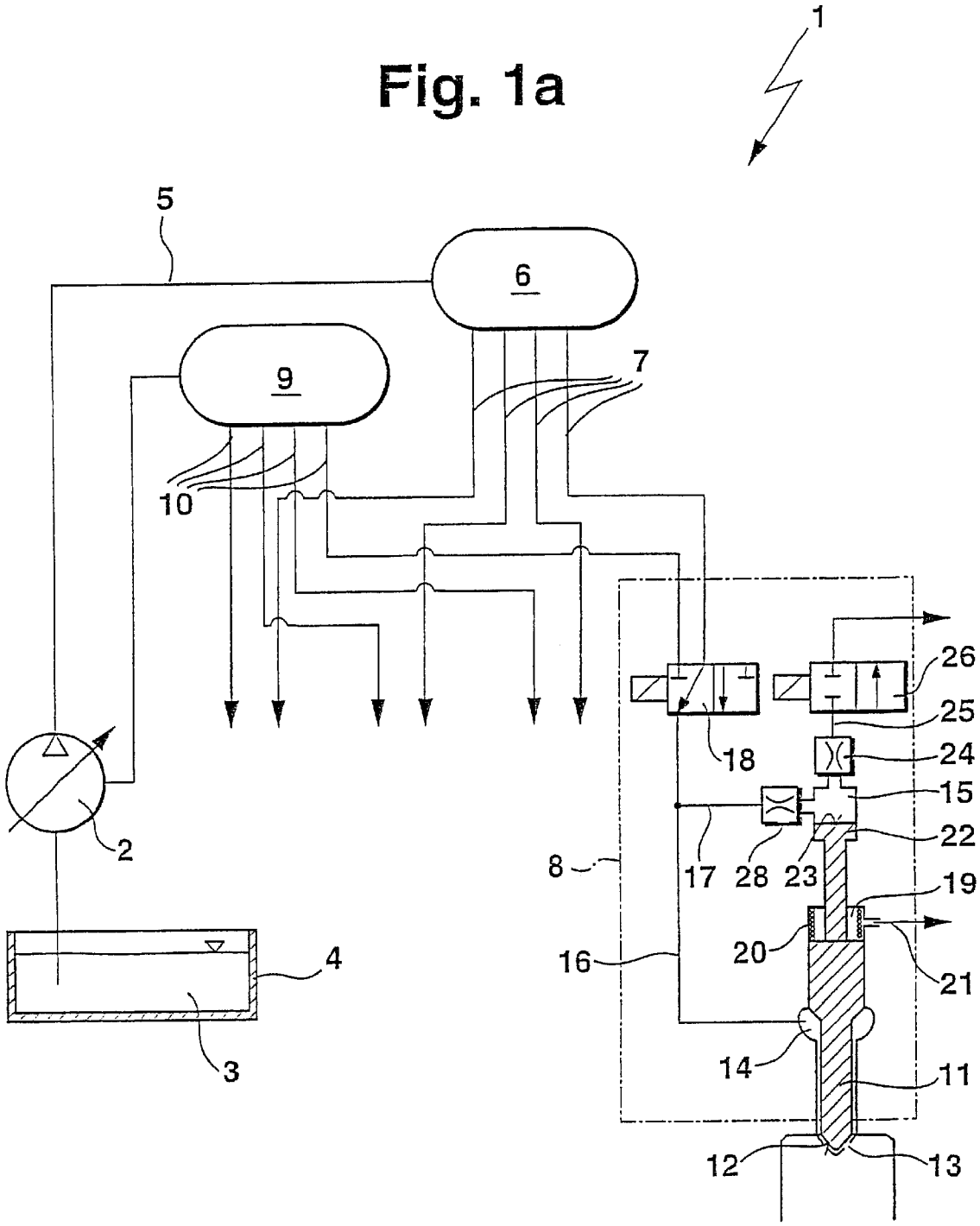
FIG. 1*a*, schematically illustrates a stroke-controlled fuel injection system with a two-stage high-pressure pump for two pressure reservoirs and with a combined fuel metering in the injector.

In the exemplary embodiment, shown in FIG. 1*a*, of a stroke-controlled fuel injection system 1, a quantity-regulated two-stage high-pressure pump 2 pumps fuel 3 out of a tank 4 at high pressure via a supply line 5 into a central pressure reservoir 6 (high-pressure common rail), from which a plurality of high-pressure lines 7, corresponding in number to the number of individual cylinders, lead away to the individual injectors 8 (injection devices) that protrude into the combustion chambers of the internal combustion engine to be supplied. In FIG. 1*a*, only one of the injectors 8 is shown. In this pressure reservoir 6, a system pressure of approximately 300 bar to 1800 bar can be stored. For injecting fuel at a lower system pressure for pre-injection and post-injection (HC enrichment for exhaust gas posttreatment and for soot reduction) and to establish a course of injection with a plateau (boot injection), a further central pressure reservoir (low-pressure common rail) 9 is used, from which analogously to the high-pressure lines 10 lead away to the injectors 8. In the first stage of the high-pressure pump 2, the fuel is compressed to this lower system pressure, for instance of 300 bar, and stored in the pressure reservoir 9. In the second stage of the high-pressure pump 2, the pressure generation is regulated to the higher system pressure, up to about 1800 bar, and stored in the pressure reservoir 6.

The injection is effected via a combined local fuel metering with the aid of the injectors 8. The injector 8 has a pistonlike valve member 11, axially displaceable in a guide bore, with a conical valve sealing face 12 on one end, with which face it cooperates with a valve seat face on the injector housing of the injector 8. Injection openings 13 are provided on the valve seat face of the injector housing. Inside the guide bore, a nozzle chamber 14 and a control chamber 15 are formed. The nozzle chamber 14 is created as a result of a cross-sectional reduction of the valve member 11. The nozzle chamber 14 and the control chamber 15 communicate constantly and continuously with one of the two pressure reservoirs 6, 9 via pressure lines 16 and 17 and a 3/2-way valve 18. The nozzle chamber 14 continues across a radial gap between the valve member 11 and the guide bore, up to the valve seat face of the injector housing.

The valve member 11 is also engaged in a spring chamber 19, coaxially with a valve spring 20, by a pressure piece 22, which with its face end 23 remote from the valve sealing face 12 defines the control chamber 15. The spring chamber 19 communicates with the tank 4 via a leakage line 21, so as to return the fuel to the tank. The control chamber 15 has an inlet, from the fuel pressure connection, with a first throttle 28 and an outlet to a pressure relief line 25 with a second throttle 24, which is controlled by a 2/2-way valve 26. The nozzle chamber 14 is continued across an annular gap between the valve member 11 and the guide bore up to the valve seat face of the injector housing. Pressure is exerted on the pressure piece 22 in the closing direction by way of the pressure in the control chamber 15.

The 2/2- and 3/2-way valves 18, 26 are actuated by electromagnets for opening or closing or switching over of the fuel lines 7 and 10. The electromagnets are triggered by a control unit, which is capable of monitoring and processing various operating parameters (engine rpm, and so forth) of the engine to be supplied. The pressure in each of the two pressure reservoirs 6, 9 can be detected by means of pressure sensors and kept constant by means of a regulating device.

Upon actuation (opening) of the 2/2-way valve 26, the pressure in the control chamber 15 can be reduced, so that as a consequence, the pressure in the nozzle chamber 14 acting in the opening direction on the valve member 11 exceeds the force exerted in the closing direction on the valve member 11. The valve sealing face 12 lifts from the valve seat face, and fuel is injected. The process of relief of the control chamber 15 and thus the stroke control of the valve member 11 can be varied by way of the dimensioning of the throttle 24 and of a further throttle 28. The end of the injection event is initiated by reactuation (closure) of the 2/2-way valve 26, which connects the control chamber 15 with the pressure line 17 again, so that once again a pressure that is capable of moving the valve member 11 in the closing direction builds up in the control chamber 15.

The 3/2-way valve 18 can also be replaced by one 2/2-way valve and one check valve. In general, instead of electromagnet-actuated valves, piezoelectric final control elements can also be used that have a requisite temperature compensation and an optional force or travel boost. Instead of two separate pressure reservoirs for the two system pressures, a combined pressure reservoir (combined rail) can also be provided. Then an external pressure storage chamber with the lower system pressure encloses an inner pressure storage chamber with the higher system pressure. In this way, only slight pressure gradients occur, which expose a housing of the pressure storage chambers to lesser material stresses and which allow the buildup of an even higher pressure, for instance, in the high-pressure storage chamber.

Figure 1B:
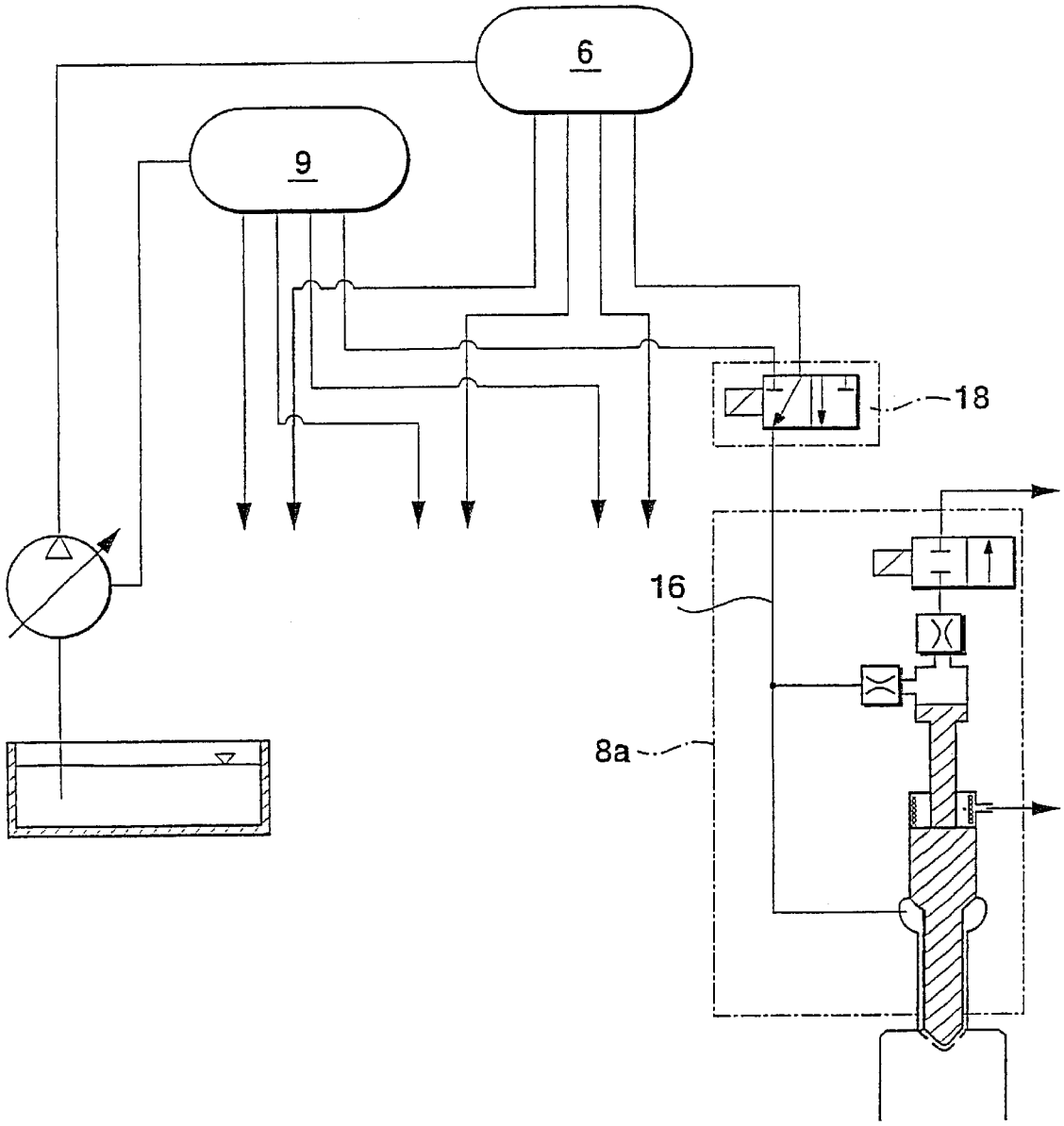
FIG. 1*b*, schematically illustrates a stroke-controlled fuel injection system with a two-stage high-pressure pump for two pressure reservoirs and with a combined fuel metering outside the injector.

In contrast to the exemplary embodiment of FIG. 1*a* , in the fuel injection system shown in FIG. 1*b* the 3/2-way valve 18 is disposed not in the injector but rather outside the injector 8*a*, for instance in the region of the pressure reservoirs 6, 9. Thus a smaller structural size of the injector 8*a*, and by exploiting wave reflections in what is now longer pressure lines 16, an increased injection pressure can then be attained.

Figure 2A:
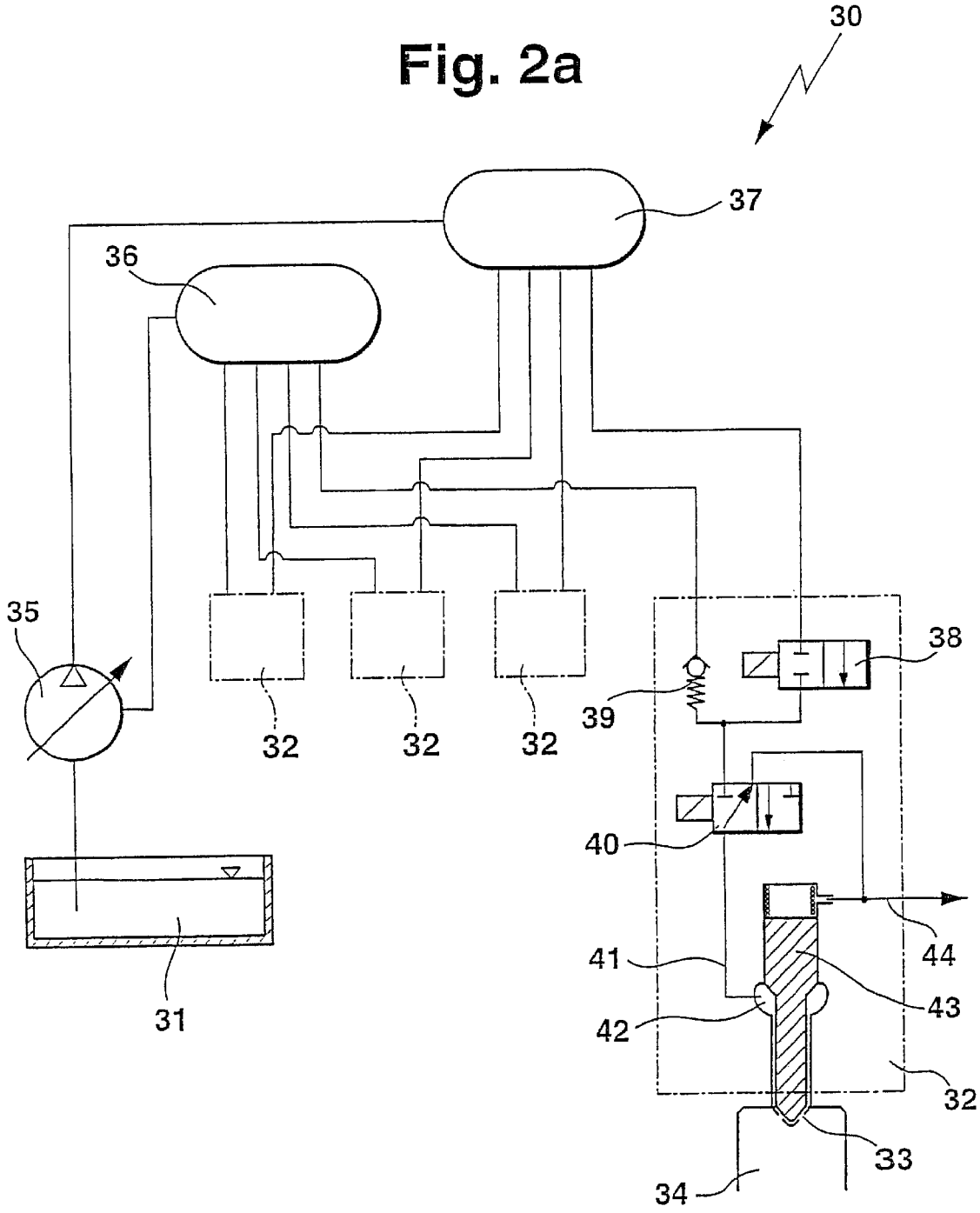
FIG. 2*a*, schematically illustrates a pressure-controlled fuel injection system with a two-stage high-pressure pump for two pressure reservoirs and with a combined fuel metering in the injector.

In the pressure-controlled injection system shown in FIG. 2*a*, fuel from a fuel tank 31 is pumped to the injectors 32 of four cylinders and from there is fed via injection openings 33 into the combustion chamber 34 of the applicable cylinder. A quantity-controlled two-stage high-pressure pump 35 is used to generate two different, high system pressures. In the first, lower pump stage, the fuel is compressed to a first, high system pressure of about 300 bar, which is stored in a first pressure reservoir 36 (first rail). With the second, higher pump stage, the fuel is compressed to a second, higher system pressure, of about 300 bar to about 1800 bar, and then stored in a second pressure reservoir 37 (second rail). For each of the two pressure reservoirs 36, 37, a separate closed-loop control circuit with a pressure sensor is provided. The lower system pressure level can be used for the pre-injection and as needed for the post-injection as well, and also for the main injection, if a lesser injection pressure is required.

For switching between the lower and the higher system pressure (combined pressure metering), one 2/2-way valve 38 for each cylinder or injector 32 is provided as a switch element for the high-pressure side, and the outlet of this valve is decoupled from the low-pressure side by a check valve 39 (or by a 3/2-way valve). Via a 3/2-way valve 40, the applicable pressure at the time is then carried over a line 41 into the nozzle chamber 42 of the injector 32, which is embodied for a pressure-controlled mode of operation. In other words, its nozzle needle 43 that seals off the injection openings 33 is opened, counter to the action of a closing force, by the pressure prevailing in the nozzle chamber 42. An injection at the lower injection pressure is effected, in the exemplary embodiment shown, by supplying electric current to the 3/2-way valve 40. By supplying current to the 2/2-way valve 38, a switchover is then made for an injection at high injection pressure; the check valve 39 prevents an unintended return flow from the high-pressure side to the low-pressure side. At the end of the injection, the 3/2-way valve 40 is switched over to leakage 44. As a result, the line 41 on one side and the nozzle chamber 42 on the other are relieved, so that the spring-loaded nozzle needle 43 closes the injection openings 33 again.

Figure 2B:
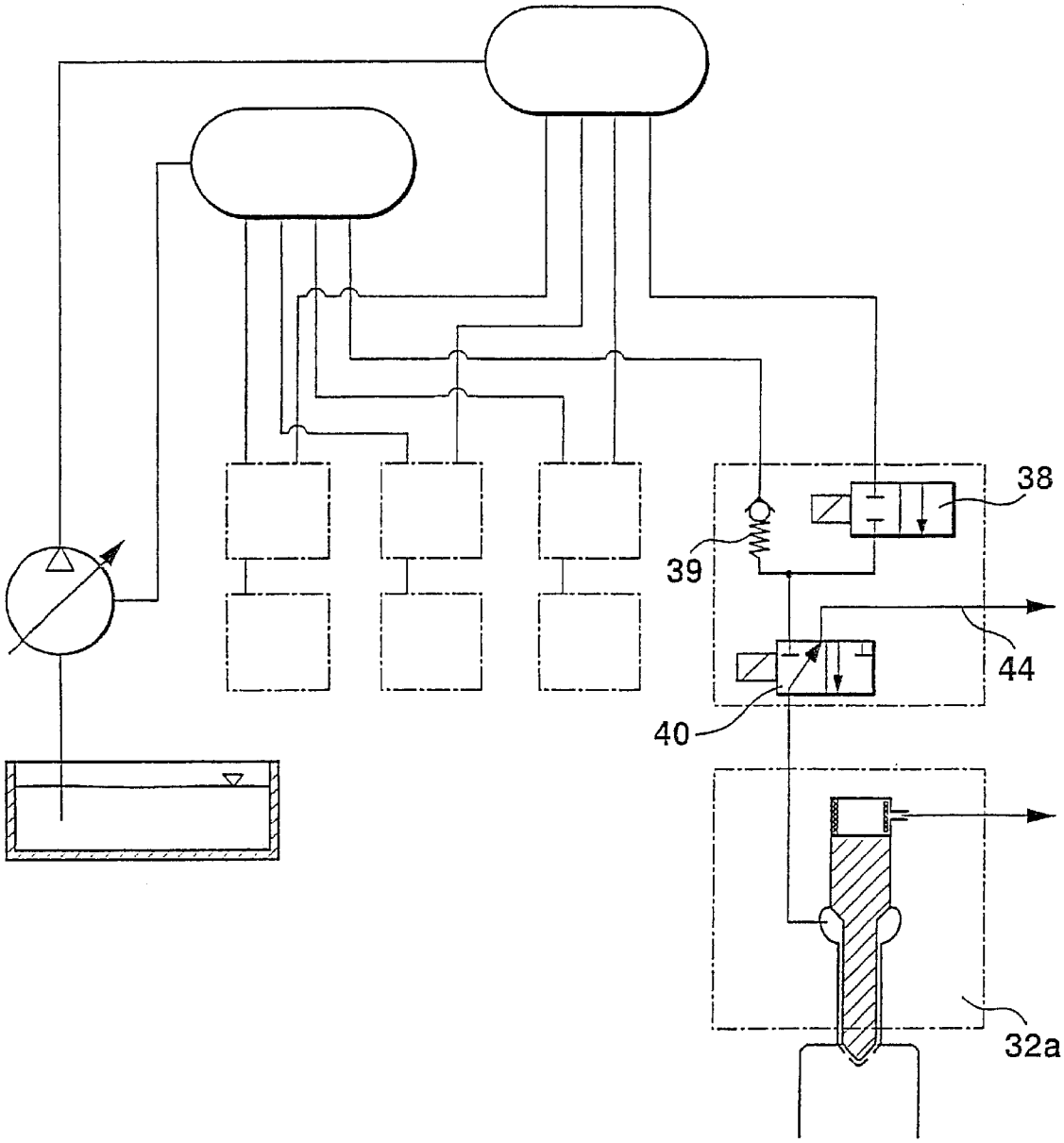
FIG. 2*b*, schematically illustrates a pressure-controlled fuel injection system with a two-stage high-pressure pump for two pressure reservoirs and with a combined fuel metering outside the injector.

While in the exemplary embodiment of FIG. 2*a*, the valve assembly formed of the two valves 38, 40 and the check valve 39 is located in the injector 32, in the injection system shown in FIG. 2*b*, this valve assembly is located outside the injector 32*a*, for instance in the region of the pressure reservoirs 36, 37. In this way a smaller structural size of the injector 32*a*, and by exploitation of wave reflections in what is now a longer injection line, an increased injection pressure can be attained.

Figure 3:
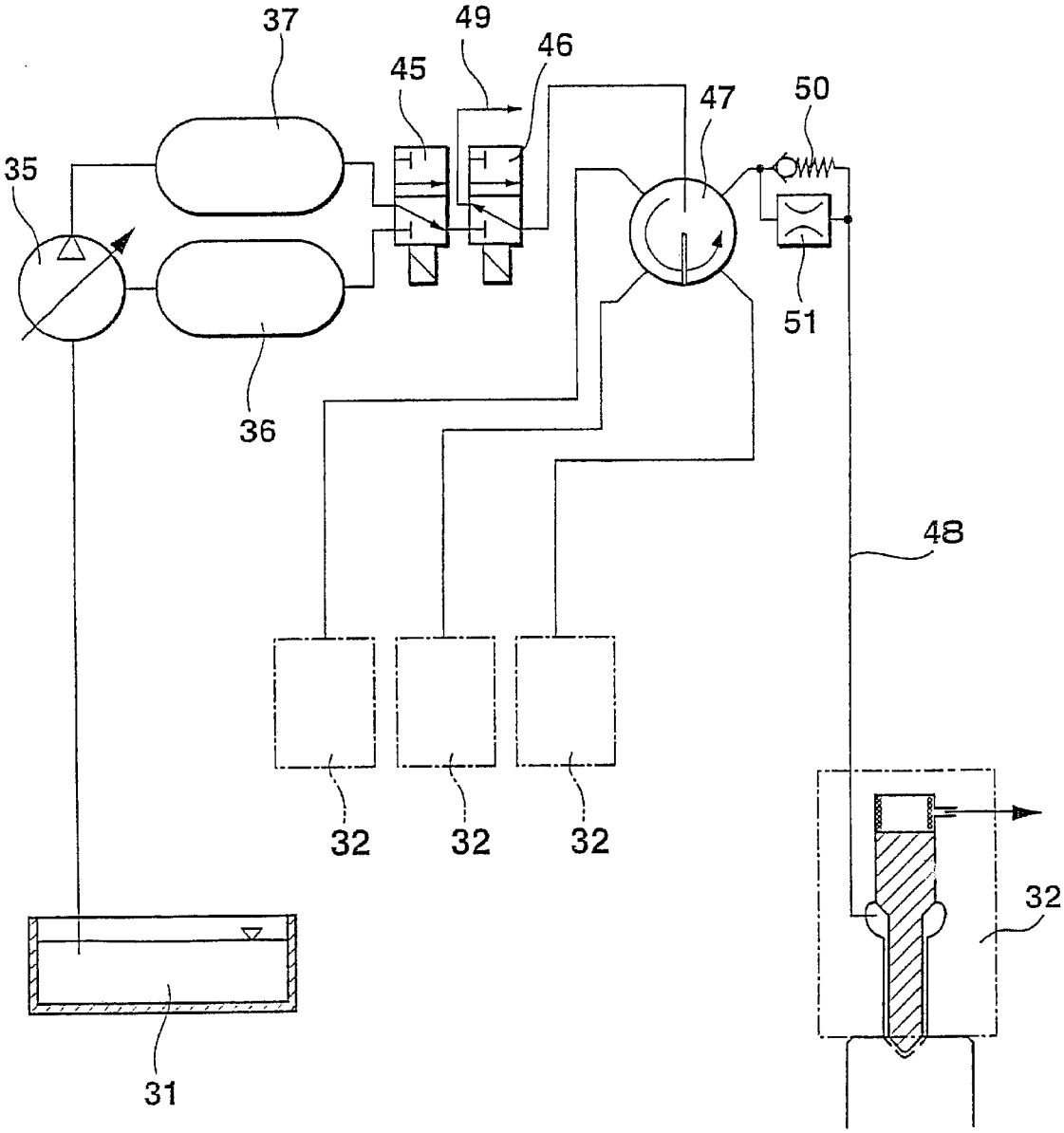
FIG. 3, schematically illustrates a pressure-controlled fuel injection system with a two-stage high-pressure pump for two pressure reservoirs and with a combined central fuel metering.

In the injection system shown in FIG. 3, a switchover can be made between the two system pressure levels centrally via a first 3/2-way valve 45 (or via one 2/2-way valve and one check valve), and then the applicable pressure can be conducted centrally via a second 3/2-way valve 46 to a central distributor device 47, which distributes the fuel via lines 48 to the injectors 32 of the individual cylinders for injection. An injection at the lower system pressure takes place in this exemplary embodiment by supplying current to both 3/2-way valves 45, 46; the injection at the higher system pressure takes place by supplying current to only the second 3/2-way valve 46. At the end of injection, the second 3/2-way valve 46 is connected to leakage 49, and thus the applicable line 48 is relieved via a valve assembly, comprising a check valve 50 and a throttle 51, that is provided between the distributor device 47 and the injector 32.

Figure 4:
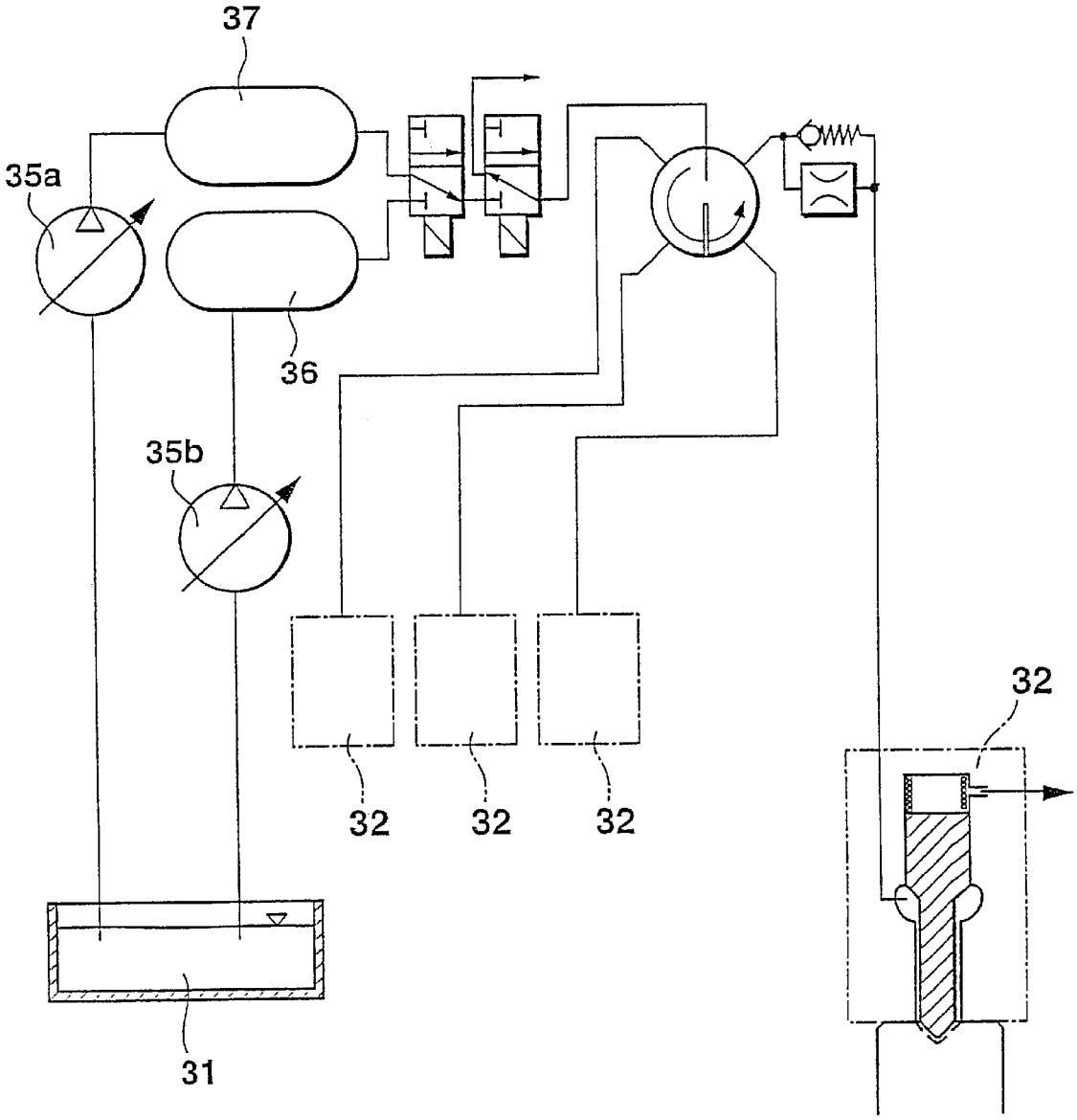
FIG. 4, schematically illustrates a pressure-controlled fuel injection system with two pressure reservoirs, each supplied by a respective high-pressure pump, and with a combined central fuel metering.

In the exemplary embodiment of FIG. 4, the two-stage high-pressure pump 35 shown in FIG. 2 is replaced by one high-pressure pump 35*a* that supplies the first pressure reservoir 37 only, and one high-pressure pump 35*b* that supplies the second pressure reservoir 36 only.

For the valves, both magnetic actuators and piezoelectric actuators, which enable faster switcher of the valves, can be used. The 3/2-way valves can also be replaced by a combination of two 2/2-way valves. For switching back and forth between the system pressure levels, an assembly that comprises a 2/2-way valve and a check valve is also possible, if there is the capability of relieving the injector.

The foregoing relates to preferred embodiments of the invention, it being understood that other variants and embodiments thereof are possible within the spirit and scope of the invention, the latter being defined by the appended claims.

We claim:

1. In a fuel injection system (1; 30) having at least two different, high system pressures for an internal combustion engine, having a first central pressure reservoir (9; 36) for the lower system pressure and having a second central pressure reservoir (6; 37), supplied from a high-pressure pump, for the higher system pressure, both pressure reservoirs (6, 9; 36, 37) being connectable by line to the injector (2; 32) of each cylinder, the improvement wherein a two-stage high-pressure pump (2; 35) is provided, by whose lower stage the first pressure reservoir (9; 36) and by whose higher stage the second pressure reservoir (6; 37) are supplied.

2. The fuel injection system of claim 1, wherein parallel to the high-pressure pump (35*a* ), provided for the second pressure reservoir (37), a further high-pressure pump (35*b* ) for the first pressure reservoir (36) is provided.

3. The fuel injection system of claim 1, wherein the fuel injection system (1) is embodied as stroke-controlled.

4. The fuel injection system of claim 1, wherein the fuel injection system (30) is embodied as pressure-controlled.

5. The fuel injection system of claim 2, wherein the fuel injection system (1) is embodied as stroke-controlled.

6. The fuel injection system of claim 2, wherein the fuel injection system (30) is embodied as pressure-controlled.

* * * * *